United States Patent [19]

van Rooden et al.

[11] Patent Number: 4,652,471

[45] Date of Patent: Mar. 24, 1987

[54] METHOD FOR MAKING POLYMERIC COMPOSITIONS USEFUL AS BINDERS IN COATING COLORS AND COATING COLORS PREPARED THEREFROM

[75] Inventors: Bernardus J. M. S. van Rooden, Richterswil, Switzerland; José L. T. Martinez, Rheinmünster, Fed. Rep. of Germany

[73] Assignee: The Dow Chemical Company, Midland, Mich.

[21] Appl. No.: 835,908

[22] Filed: Apr. 11, 1986

Related U.S. Application Data

[62] Division of Ser. No. 605,026, Dec. 22, 1983, Pat. No. 4,602,059.

[30] Foreign Application Priority Data

May 3, 1982 [EP] European Pat. Off. ..... 82.200530.2

[51] Int. Cl.[4] ..... B05D 1/36; B05D 7/04

[52] U.S. Cl. ..... 427/411; 101/141; 427/391; 428/511; 428/514

[58] Field of Search ..... 427/391, 411

[56] References Cited

U.S. PATENT DOCUMENTS

| | | |
|---|---|---|
| 3,365,410 | 1/1968 | Wesslau et al. . |
| 3,903,035 | 9/1975 | Affeldt et al. . |
| 4,157,995 | 6/1979 | Schenck et al. . |
| 4,309,321 | 1/1982 | Aihara et al. . |
| 4,321,181 | 3/1982 | Barabas et al. . |

*Primary Examiner*—Allan M. Lieberman

*Attorney, Agent, or Firm*—Thomas D. Zindrick

[57] ABSTRACT

A coating color possessing desirable rheological and other properties is prepared from a binder composition comprising two polymeric components wherein one of said polymeric components is a lightly cross-linked copolymer derived from an ester of an $\alpha,\beta$-ethylenically unsaturated carboxylic acid, and $\alpha,\beta$-ethylenically unsaturated carboxylic acid, an unsaturated carboxamide and, optionally, one or more other comonomers. Paper coating with the coating colors containing the binder composition exhibit high binding strengths and excellent printability.

2 Claims, No Drawings

METHOD FOR MAKING POLYMERIC COMPOSITIONS USEFUL AS BINDERS IN COATING COLORS AND COATING COLORS PREPARED THEREFROM

CROSS-REFERENCE TO RELATED APPLICATION

This is a divisional of application Ser. No. 605,026, filed Dec. 22, 1983, now U.S. Pat. No. 4,602,059.

The present invention relates to a synthetic polymer composition useful as the binder component in coating colors and to the coating colors containing these polymeric compositions.

In the production of paper, the paper surface is often coated with a composition (commonly referred to as a coating color) which imparts desirable properties such as printability to the paper. In one conventional method for applying the coating color, the coating is continuously transferred as a liquid film from an applicator roll to the paper surface, with any applied excess removed using suitable means such as blade or air-knife techniques.

For various reasons, paper producers have continuously strived to reduce the finished weight of the coated paper. One method by which can be achieved is by reducing the amount of the coating color applied to the paper. Unfortunately, a reduction in te coat weight generally results in a drop of the finished paper properties, particularly in the print quality. To effectively coat the paper, at the desirably coat weight, the coating colors advantageously exhibit desirable physical properties, e.g., stability, and rheological properties. These properties are particularly important in the preparation of high quality paper grades such as those printed by gravure techniques.

Conventionally, the coating color consists primarily of a suspension of a pigment and/or filler such as clay in an aqueous medium containing a binder. Heretofore, natural high molecular weight materials such as starch or protein have been used as a binder. Unfortunately, these natural materials are susceptible to attack by microorganisms and when employed alone give brittle coatings. Moreover, using a starch binder, the coated paper often does not possess the required print quality due to insufficient coat hold-out, i.e., excessive penetration of the coatings into the paper.

It has therefore been suggested to employ synthetic polymers as the binder in paper coatings. Many such synthetic polymer binders consist of two polymeric components with one copolymer being employed primarily to impart the desired binding strength and other properties to the coated paper and the second copolymer component being employed primarily to affect the rheological properties of the coating colors prepared therefrom. For example, German Pat. No. 1,546,315 discloses a synthetic polymer binder comprising 60–95 percent of a first copolymer of butadiene, styrene and/or acrylonitrile and 5–40 percent of a second copolymer of acrylic or methacrylic acid, a monomer which forms a water-insoluble homopolymer (at least a portion of which is an ester of acrylic or methacrylic acid) and, optionally acryl- or methacrylamide. Unfortunately, the properties of paper coated with coating colors prepared from this binder are generally deficient, particularly using gravure printing techniques, due again to insufficient coat hold-out.

A similar synthetic polymeric binder except that the first copolymer is derived from an ester of acrylic or methacrylic acid, a vinyl ester or propionic acid, and optionally other copolymerizable monomers, is described by U.S. Pat. No. 3,365,410. While coating colors prepared using these polymeric binders improve the print quality of paper prepared therefrom, a further improvement in the balance of the paper properties is required.

In view of the aforementioned deficiencies of the synthetic polymer binders employed heretofore, it remains highly desirable to provide a polymeric composition which can effectively be employed as the binder in a paper coating color to impart an improved balance of properties in the paper coated therewith.

Accordingly, the present invention is such an improved polymeric composition useful as the binder component in a coating color. The polymeric composition is composed of two polymeric components, the improvement in said composition comprising the inclusion, as one of the two polymeric components, of a lightly crosslinked copolymer comprising, in polymerized form, an ester of an $\alpha,\beta$-ethylenically unsaturated carboxylic acid, an $\alpha,\beta$-ethylenically unsaturated carboxylic acid, an unsaturated carboxamide, and optionally, one or more other comonomers. The lightly crosslinked copolymer (hereinafter referred to as the "rheology control copolymer") is cross-linked sufficiently to improve the rheological and/or other properties of the polymeric composition and/or coating colors prepared therefrom.

In general, such cross-linking in the copolymer is achieved by using a small amount (i.e., from 0.01 to 10 weight percent) of a cross-linking monomer. The other copolymer (hereinafter referred to as the "binder copolymer" is generally a copolymer of a monovinylidene aromatic, a conjugated diene and, optionally, other copolymerizable monomers or a copolymer of an ester of an $\alpha,\beta$-ethylenically unsaturated carboxylic acid, a comonomer which forms a water-insoluble homopolymer and, optionally, one or more copolymerizable monomers.

The coating colors containing a sufficiently crosslinked polymeric component possess rheological and/or other properties which cannot be obtained without a cross-linked component. In addition, the flexibility imparted by the cross-linked structure allows ready adaptability of the polymeric binder composition to various formulations in the preparation of coating colors. Paper coated with the coating colors exhibit unexpectedly high binding strengths and excellent printability.

In a particularly preferred embodiment, the binder copolymer comprises, based on 100 weight parts, at least 60 weight parts, in polymerized form, of from 10–90 weight percent of a conjugated diene, said weight percents being based on the total weight of the monovinylidene aromatic and the conjugated diene. The binder copolymer can optionally comprise, in polymerized form, up to 20 weight parts of an $\alpha,\beta$-ethylenically unsaturated carboxylic acid and up to 20 weight parts of other copolymerized monomers. The rheology control polymer comprises, based on 100 weight parts, in polymerized form, from 40–90 weight parts of an ester of an $\alpha,\beta$-ethylenically unsaturated carboxylic acid; from 1–30 parts of an $\alpha,\beta$-ethylenically unsaturated carboxylic acid; from 5–15 weight parts of an unsaturated carboxamide; from 0.5–20 weight parts of an ethylenically unsaturated nitrile and from 0.01–10 weight parts of a cross-linking monomer.

The polymeric compositions of the present invention are useful as the binder component in various compositions, particularly coating colors. They are particularly useful in the preparation of coating colors employed in preparing paper for high quality printing such as in the preparation for rotogravure printing.

The polymeric composition of the present invention comprises two polymeric components, herein referred to as a binder copolymer and a theological control polymer. The binder copolymer which primarily imparts the binding strengths and other properties to the coated paper is preferably derived from a monovinylidene aromatic, a conjugated diene and, optionally, other monomers copolymerizable therewith. Representative monovinylidene aromatics include styrene; α-alkyl styrene such as α-methyl styrene and α-ethyl styrene; nuclear substituted, alkyl substituted styrenes such as vinyl toluene, o-ethyl styrene, 2,4-dimethyl styrene; nuclear substituted halo-styrene such as chlorostyrene and 2,4-dichlorostyrene; styrene substituted with both a halo and alkyl group such as 2,2-chloro-4-methyl styrene and combinations thereof. In general, styrene, or a combination of styrene with small amounts (i.e., less than 10 weight percent based on the weight of the monovinylidene aromatic employed) of one or more other monovinylidene aromatics, particularly an α-alkylstyrene, are preferred. Most preferably, styrene is employed as the monovinylidene aromatic. The conjugated diene is an alkadiene, preferably a 1,3-conjugated diene such as butadiene, isoprene, properylene, chloropene and the like. The preferred conjugated diene is 1,3-butadiene.

Often, but optionally, the binder copolymer comprises one or more additional copolymerizable monomers. Such comonomers are employed to vary the properties of the resulting polymer and the specific comonomers and their amounts selected to obtain a copolymer having desirable properties. For example, to increase the binding strength of a coated paper, it is often desirable to employ an α,β-ethylenically unsaturated carboxylic acid such as acrylic, methacrylic, itaconic, fumaric or maleic acid in the preparation of the binder copolymer. Preferred of such acids are itaconic or acrylic acid or a combination thereof. Other comonomers which are often advantageously employed in the preparation of such copolymer binder include unsaturated nitriles such as acrylonitrile and methacrylonitrile, the halo-substituted olefins such as vinylidene chloride, esters of α,β-ethylenically unsaturated carboxylic acids, ethylenically unsaturated amides such as acrylamide and methylacryl amide, and the ethylenically unsaturated alcohols.

The relative proportions of the monovinylidene aromatic, conjugated diene and other comonomers, if employed in the preparation of the preferred binder copolymer, are dependent on a variety of factors including the specific monovinylidene aromatic and conjugated diene employed and are typically selected on the basis of the desired properties of the binder copolymer. For example, the binder copolymer advantageously exhibits a second-order transition temperature, as defined by P. J. Flory in "Principles of Polymer Chemistry" published in 1953 by Cornell University Press, Ithaca, N.Y., page 56 between −60° and +40° C. and the monomers and their amounts selected accordingly. In general, the binder copolymer comprises at least 60, preferably at least 80, more preferably at least 90, weight percent of the monovinylidene aromatic and conjugated diene, said weight percents being based on the total weight of the first copolymer. In general, the monovinylidene aromatic is employed in amounts from 10–90, preferably from 50–70, weight percent and the conjugated diene is employed in amounts from 10–90, preferably from 30–50, weight percent, said weight percents being based on the total amount of monovinylidene aromatic and conjugated diene employed in the preparation of the binder copolymer. The α,β-ethylenically unsaturated carboxylic acids are employed in amounts from 0–20 weight percent, preferably from 1–5 weight percent, and the other copolymerizable monomers are employed in amounts from 0–20, more generally from 0–5, weight percent, said weight percent being based on the total weight of the binder copolymer. In general, the binder copolymer of the present invention is preferably derived from 50–70 weight percent of a monovinylidene aromatic, particularly styrene, from 30–50 weight percent of a conjugated diene, particularly 1,3-butadiene, and from 1–5 weight percent of an α,β-ethylenically unsaturated carboxylic acid, particularly itaconic acid, acrylic acid or a combination thereof.

Alternatively, but less preferably, the binder copolymer is derived from an ester of an α,β-ethylenically unsaturated carboxylic acid and a comonomer which forms a water-insoluble homopolymer. Representative esters are the esters of acrylic and/or methacrylic acid with alcohols having from 1–8 carbon atoms including ethyl acrylate, n-butylacrylate, i-butylacrylate, 2-ethylhexylacrylate and the like. Esters of acrylic acid with alcohols having from 4–8 carbon atoms are preferred. Representative comonomers which form a water-insoluble homopolymer include generally the monovinylidene aromatics, particularly styrene; the unsaturated nitriles, particularly acrylonitrile; the vinyl esters of a monocarboxylic acid, particularly vinylacetate or vinylpropionate; the halo-olefins such as vinyl chloride or vinylidene chloride; or a combination thereof. The preferred of such comonomers are the vinyl esters, particularly vinyl acetate and vinyl propionate. In general, the binder copolymer will comprise from 10–90, preferably from 35–60, weight percent of the ester of an unsaturated carboxylic acid and from 10–90, preferably from 35–60, weight percent of the vinyl acetate, and optionally, up to 10 weight percent of a further comonomer, said weight percents being based on the total weight of the binder copolymer. Although such further comonomer can be a comonomer which forms a water-insoluble homopolymer, it is more advantageously an α,β-ethylenically unsaturated carboxylic acid, preferably an acid having from 3–5 carbon atoms, including acrylic, methacylic, crotonic, maleic, fumaric or itaconic acid and their amides, monoalkylamides, dialkylamides, N-methylolamides and esters of the N-methylolamides, including the half amides and half esters of the dicarboxylic acids; or a more strongly acidic comonomer such as vinyl sulfonic acid and p-toluene sulfonic acid. Preferred of such comonomers are the α,β-ethylenically unsaturated acids, particularly those acids having 3–5 carbon atoms. These acids are preferably employed in amounts from 0.1–5 weight percent based on the total weight of the binder copolymer.

The rheology control polymeric component comprises a lightly cross-linked copolymer of an α,β-ethylenically unsaturated acid, an ester of an α,β-ethylenically unsaturated carboxylic acid; an unsaturated carboxamide and, optionally, one or more other comonomers, preferably an unsaturated nitrile.

The ester of the $\alpha,\beta$-ethylenically unsaturated acids advantageously employed in the present invention are those esters of a carboxylic acid having from 3–5 carbon atoms such as acrylic, methacrylic, maleic, fumaric or itaconic acids, (preferably acrylic or methacrylic acids) with alcohols having from 2–10 carbon atoms, preferably 2–4 carbon atoms. Exemplary examples of such esters are ethyl acrylate, propyl acrylate, butyl acrylate, propyl methacrylate, butyl acrylate and the like.

The unsaturated carboxylic acids advantageously employed herein are those carboxylic acids which contain from 3–10 carbon atoms. Representative of such acids are acrylic, methacrylic, crotonic, itaconic, fumaric and ethylacrylic acids.

Representative of ethylenically unsaturated carboxyamides include acrylamide, methacrylamide, crotonamide, itaconamide, maleic acid monoamide and ethylacrylamide.

Representative of ethylenically unsaturated nitriles include acrylonitrile, methacrylonitrile, maleic nitrile and cinnamonitrile.

In general, a cross-linking monomer, i.e., a copolymerizable monomer which when included in the polymerization recipe introduces cross-linkage into the resulting polymer, is employed to lightly cross-link the rheology control. Representative cross-linking monomers include the ethylenically unsaturated monomers which contain two or more non-conjugated terminal ethylenic groups. Examples of such monomers are the polyvinylidene aromatics such as divinyl benzene, divinyl toluene, divinyl xylene and trivinyl benzene; the allyl or butenyl acrylates and/or methacrylates such as allyl methacrylate, ethylene glycol dimethylacrylate and the like. Preferred cross-linking monomers contain from 4–15 carbon atoms, with allyl acrylate and allyl methacrylate being most preferred.

The specific monomeric components and the relative proportions of each, including the cross-linking monomer and its amounts, most advantageously employed in preparing the rheology control polymer are dependent on a variety of factors including the composition of the coating color prepared therefrom. For example, if the binder copolymer is a copolymer of an ester of an unsaturated acid and a vinyl ester of an unsaturated carboxylic acid, the desired polymeric properties of the copolymers can often be obtained using a lightly cross-linked polymer derived from the ester of an unsaturated carboxylic acid, preferably from 40–90 weight percent of an ester of acrylic acid with an alcohol having from 1–8 carbon atoms; the unsaturated carboxylic acid, preferably from 5–40 weight percent of acrylic and/or methacrylic acid; and an unsaturated carboxamide, preferably from 0.5–10 weight percent of acrylamide and/or methacrylamide, said weight percents being based on the total weight of the rheology control polymer. The cross-linking is advantageously incorporated using from 0.05–5 weight percent of a cross-linking monomer, preferably from 0.05–2 weight percent of allyl acrylate or methacrylate. In addition, small amounts (i.e., less than 10 weight percent) of other comonomers such as an unsaturated nitrile, a monovinylidene aromatic, a vinyl ester of a monocarboxylic acid can optionally be employed.

Alternatively, when the binder copolymer is a copolymer derived primarily from a monovinylidene aromatic and a conjugated diene, to obtain the most desirable properties it is generally necessary to employ an unsaturated nitrile in combination with the unsaturated carboxylic acid, the ester of an unsaturated acid and the unsaturated carboxamide in the preparation of the rheology control copolymer. Advantageously, in such case the lightly cross-linked rheology control copolymer is derived from 45–90 weight percent of the ester of an unsaturated carboxylic acid, preferably from 45–75 weight percent of ethyl acrylate and/or ethyl methacrylate; from 1–30 weight percent of an unsaturated carboxylic acid, preferably from 5–25 weight percent acrylic and/or methacrylic acid; from 5–15 weight percent of the unsaturated carboxamide, preferably from 8–15 weight percent acrylamide and/or methacrylamide and from 0.05–20 weight percent of an unsaturated nitrile, preferably from 5–20 weight percent of acrylonitrile or mixtures of acrylonitrile with maleic nitrile or methacrylonitrile; and 0.01–10 weight percent of a cross-linking monomer, preferably from 0.05–5 weight percent of allyl acrylate and/or allyl methacrylate, wherein said weight percents are based on the total weight of the rheology control.

Most preferably, the rheology control copolymer comprises, in polymerized form, from 50–70 weight percent ethyl acrylate, from 10–20 weight percent methacrylic acid, from 8–15 weight percent acrylamide, from 10–20 weight percent acrylonitrile and from 0.05–2 weight percent of a cross-linking monomer, particularly allyl methacrylate.

The binder copolymer and rheology control copolymer are prepared separately using continuous, semicontinuous or batch emulsion polymerization techniques. Such techniques are well known in the art and reference is made thereto for the purposes of this invention. In general, the polymeric components are prepared by dispersing the desired monomers in an aqueous polymerization medium which typically contains an emulsifying agent and other conventionally employed polymerization acids, e.g., chain transfer agent, chelating agents.

Free radical initiation means which are advantageously employed include UV light and conventional chemical initiators such as peroxygens, e.g., hydrogen peroxide and cumene hydroperoxide; persulfate, e.g., potassium persulfate, sodium persulfate and ammonium persulfate; organic azo compounds such as azobisisobutylnitrile; redox initiators such as peroxide in combination with a sulfite or thiosulfate reducing agent; and the like. Typically, such initiators are employed in amounts which generally range from 0.01–5 weight percent based on the total weight of the monomers being polymerized.

In preparing the copolymers, surfactants advantageously employed are anionic and nonionic surfactants conventionally heretofore in emulsion polymerizations. Representative anionic surfactants useful herein include the alkyl aryl sulfonates such as sodium dodecyl benzene sulfonate, alkyl phenoxy polyethylene sulfonates and phosphates, sodium lauryl sulfate, potassium lauryl sulfonate and the like. Representative nonionic surfactants useful herein include the reaction product of an alkylene oxide with alkylated phenols or long chain, e.g., from 6–20 carbon atoms, fatty alcohols, fatty acids, alkyl mercaptans and primary amines, mono esters, e.g., the reaction product of polyethylene glycol with a long chain carboxylic acid with polyglycol esters of a polyhydric alcohol. The surfactants are employed in an amount which effectively stabilizes the dispersion during polymerization. In general, such amount will vary from 0.1–5 weight percent based on the total weight of the monomers employed. To assist in controlling the molecular weight of the resulting polymers, a chain transfer agent is often, but optionally included in the aqueous polymerization medium. In general, chain transfer agents which have conventionally been employed heretofore in emulsion polymerization processes can be employed in the practice of the present invention. Representative of such chain transfer agents include the mercaptans such as n-dodecyl mercaptan cyclohexene, bromoform, carbon tetrabromide, carbon tetrachloride and the like. When employed, the chain transfer agents are generally advantageously employed in amounts from 0.05–5 weight percent based on the total weight of the monomers.

Polymerization is advanteously conducted at as low a temperature sufficient to polymerize the monomers at a practical rate. In general, the polymerization is conducted at temperatures from 40°–100° C., preferably from 60°–90° C., for periods sufficient to convert desired amounts of monomer to the desired polymer, (generally the conversion of at least 90 percent of the monomer to polymer), which conventionally takes from 1–6 hours. The polymer dispersions may be prepared over a wide range of concentrations, with the resulting aqueous dispersions advantageously ranging from 20–60 weight percent solids.

The polymeric composition of the present invention is prepared by admixing the desired amounts of the binder copolymer with the rheology control copolymer. The relative concentrations of the binder copolymer and the rheology control copolymer are selected on the basis of the desired properties of the polymeric composition and the coating color prepared therefrom. In general, the binder copolymer is employed in amounts from 50–97, preferably 60–90, more preferably 70–90, weight percent, and the rheology control copolymer is used in amounts from 3–50, preferably 10–40, more preferably 10–30, weight percent, said weight percents being based on the total weight of the two copolymers.

The method by which the two polymers are admixed is not particularly critical to the practice of the present invention. In general, the two polymer dispersions will be compatible with one another, especially if any carboxyl either or both copolymer are not neutralized or only partially neutralized prior to admixture. The admixture of the two polymer dispersions is readily achieved by mixing the dispersion of the first binder copolymer, as prepared, with the dispersion of the rheology control copolymer, as prepared, using mild agitation.

In the preparation of coating colors using the polymeric compositions of this invention as the binder component, the polymeric composition of the present invention is commonly admixed with other such as fillers and/or pigments including clay and, optionally chalk, or calcium carbonate, and, if desired, other adjuncts such as dispersing agents, lubricants or the like. Although such adjuncts can be mixed with either copolymer prior to the subsequent admixture of the copolymers, an aqueous dispersion of the pigment and/or filler is generally prepared and the copolymers are added thereto, with agitation, shortly before use. Prior to the application of a coating color containing the polymeric composition of the present invention to a paper surface, the carboxylic groups are advantageously neutralized by adding a basic material such as sodium or potassium or ammonia, preferably sodium hydroxide. The alkali is added in an amount sufficient to give the aqueous dispersion containing the polymer a pH from 8–9.5. The resulting coating color can be applied to raw papers using any of the known methods.

The following example is set forth to illustrate the invention and should not be construed to limit its scope. In the examples, all parts and percentages are by weight unless otherwise indicated.

EXAMPLE

Preparation of the Binder Copolymer

To a suitably sized polymerization flask equipped with agitation means, heating and cooling means, thermometer, and addition funnel, is added 60 parts water, 0.1 parts of an anionic surfactant, 0.8 part of a free-radical initiator and 3 parts of a chain transfer agent. The vessel is purged with nitrogen and heated to 90° C. Over a 4 hour period, 57 parts of styrene, 39 parts of butadiene, 1 part of itaconic acid and 3 parts of acrylic acid are added cocurrently with an aqueous stream comprising additional surfactant and free-radical initiator. The vessel is maintained at 90° C. during this addition and for an additional 2 hours. At this time, the polymerization is stopped. The resulting emulsion contains 50 percent solids and the particle size of the resulting styrene/butadiene/itaconic acid/acrylic acid copolymer is found to be approximately 1800 Å.

Preparation of the Rheology Control Polymer

To a suitable sized polymerization vessel similar to that used in the preparation of the first copolymer is added 148 parts of water, 0.02 part of a chelating agent and 0.5 part of an anionic surfactant. The vessel is then heated to 80° C. A first monomer feed stream comprising 60 parts ethylacrylate, 15 parts acrylonitrile, 15 parts methacrylic acid and 0.1 part of alkylmethacrylate are added to the mildly stirred aqueous polymerization mixture for a period of about 4 hours. A second separate monomer addition comprising a solution of 40 parts of water and 10 parts acrylamide with 0.005 part of a chelating agent is simultaneously added to the reaction vessel, except that this addition is initiated about 15 minutes after the first monomer stream. Coincident with the addition of the monomers, an additional 50 parts water, 2.0 parts of anionic surfactants, 0.1 part of sodium hydroxide, and 0.7 part of a free-radical initiator is added to the polymerization medium. The temperature of the vessel is maintained at 80° C. during the addition of the monomer and polymerization aids and for an additional 2 hours. At the end of this period, the flask is then cooled to ambient temperatures and the subsequent emulsion subjected to steam distillation to remove the unconverted monomer. The resulting emulsion contains about 30 percent solids.

Preparation of Coating Color

A polymeric blend is prepared by admixing, with mild agitation, 80 parts, on a dry basis, of the emulsion containing the binder copolymer with 20 parts, on a dry basis, of the emulsion containing the rheology control copolymer to form a blend of 44 weight percent solids.

A paper coating composition is prepared by adding 5 parts of this blend to 100 parts of a Dinkie A clay dispersed in an aqueous solution of 0.1 part sodium polyacrylate and 0.2 part sodium metaphosphate using vigorous agitation. The pH of the resulting admixture is then adjusted to 8.5 by the addition of caustic soda. The resulting paper coating (Sample No. 1) comprises 56 percent solids with a viscosity of 2150 cps measured using a Brookfield viscometer, type No. RVT, using Spindle No. 5 at 100 rpm and 25° C.

In a similar manner, a paper coating (Sample No. 2) is prepared by blending 75 parts (dry basis) of emulsion containing the binder copolymer with 25 parts (dry basis) of the emulsion containing the rheology control copolymer. The paper coating is found to have solids of about 56 percent with a viscosity of 2150 cps.

Each of the paper coating are separately applied on a base paper of 36 grams per square meter ($g/m^2$) at a speed of 600 m/min and at 10 $g/m^2$ coat weight with 6 percent moisture using a conventional blade coating technique. Excellent runability characteristics were observed. The binding strength and printability of the coated paper were measured. The results of these measurements are presented in Table No. 1.

For purposes of comparison, Table No. 1 reports the binding strength and printability exhibited by two coating colors prepared using polymeric binders described in the prior art (Sample Nos A and B).

TABLE I

| Sample No. | Polymeric Binder (1) First Copolymer:Second Copolymer Monomers | Weight Percent | Percent CB:RCP | Viscosity, Cps (4) | Strength cm/sec (5) | Printability mm (6) |
|---|---|---|---|---|---|---|
| 1 | S/Bd/IA/AA: EA/MAA/VCN/ AAm/AM | 57/39/1/3: 60/15/15/10/0.1 | 80:20 | 2150 | 57 | 46 |
| 2 | S/Bd/IAAA: /EA/MAA/VCN/ AAm/AM | 57/39/1/3: 60/15/15/10/0.1 | 75:25 | 2500 | 48 | 35 |
| A | (2) | — | — | 2100 | 24 | 38 |
| B | (3) | — | 80:20 | 2600 | 39 | 21 |

(1) Polymeric Binder: The components of the polymeric binder are expressed in abbreviations with S = styrene, Bd = butadiene, IA = itaconic acid, AA = acrylic acid, EA = ethyl acrylate, MAA = methacrylate acid, VCN = acrylonitrile, AAm = acrylamide and AM = allyl methacrylate; Weight Percent refers to the weight percent of each monomer in the specific component based on the total weight of that polymeric component; Percent CB:RCP refers to the weight percent of the binder copolymer and rheology control polymer in preparing the polymeric composition.
(2) A representative, acrylic polymeric binder composed of a first copolymer of an acrylate and vinyl acetate and a second copolymer of an acrylate, carboxylic acid and amide.
(3) A polymeric binder composed of a first copolymer of a styrene/butadiene/itaconic acid/acrylic acid as employed in preparing Samples Nos. 1 and 2 and a second copolymer derived from 70 parts of ethyl acrylate, 20 parts of methacrylic acid and 10 parts of acryl amide.
(4) Viscosity is measured using a Brookfield Viscometer, Model RVT, using Spindle No. 5, at 100 rpm and 20° C.
(5) Binding strength is measured using conventional IGT test equipment with a pendulum drive. Results are reported in centimeter per second to the first pick of the coated paper using a low viscosity oil at a printing pressure of 350 newtons per square centimeter.
(6) Printability is measured using a testing device, for measuring printability of paper printed using rotogravure printing techniques, which has been adapted to a pendulum drive IGI tester, Type 2A. Results are reported in millimeters (mm) to twenty missing dots using a printing pressure of 250 newtons/$cm^2$.

As evidenced by the data presented in Table No. I the polymeric compositions of the present invention are exceptional binders for paper coatings. Specifically, the paper coatings prepared using the polymeric compositions of the present invention impart unexpectedly high binding strengths in combination with excellent printability characteristics.

A paper coated with a coating color derived from a binder composition comprising 70 percent of a binder copolymer derived from 50 parts of butyl acrylate, 47 parts of vinyl acetate and 3 parts of acrylic acid and 30 percent of a rheology control polymer derived from 75 parts of ethyl acrylate, 20 parts of acrylic acid, 5 parts of acrylamide and 0.1 part of allyl methacrylate possesses similarly superior properties as exhibited by the papers coated with coating colors designated Sample Nos. 1 and 2.

What is claimed is:

1. A method for printing paper wherein paper is coated with a coating color and subsequently printed using rotogravure printing techniques characterized by the fact that the coating color comprises a suspension of a pigment and/or filler in an aqueous medium, a binder component comprising, based on 100 weight parts, from about 50–97 weight parts of a binder copolymer comprising at least 60 weight percent, in polymerized form, of a monovinylidene aromatic and a conjugated diene, the monovinylidene aromatic and conjugated diene being employed in amounts such that the monovinylidene aromatic comprises from about 10–90 weight percent and the conjugated diene comprises from about 10–90 weight percent of the total weight of the monovinylidene aromatic and conjugated diene employed, and optionally, in polymerized form, up to 20 weight percent of an $\alpha,\beta$-ethylenically unsaturated carboxylic acid and up to 20 weight percent of other copolymerized monomers, said weight percents based on the total weight of the binder copolymer, and from about 3–50 weight parts of a rheology control copolymer comprising, in polymerized form, from about 40–90 weight percent of an ester of an $\alpha,\beta$-ethylenically unsaturated carboxylic acid, from about 1–30 weight percent of an $\alpha,\beta$-ethylenically unsaturated carboxylic acid, from about 5–15 weight percent of an ethylenically unsaturated carboxamide, from about 0.5–20 weight percent of an unsaturated nitrile and from about 0.01–10 weight percent of a cross-linking monomer, and optionally, from 0–20 weight percent of other copolymerizable monomers, said weight percents based on the total weight of the rheology control copolymer.

2. A method for printing paper wherein paper is coated with a coating color and subsequently printed using rotogravure printing techniques characterized by the fact that the coating color comprises a suspension of a pigment and/or filler in an aqueous medium, a binder component comprising, based on 100 weight parts, from about 50–97 weight parts of a binder copolymer comprising, in polymerized form, from about 10–90 weight percent of an ester of an $\alpha,\beta$-ethylenically unsaturated carboxylic acid, from about 10–90 weight percent of a comonomer which forms a water-soluble homopolymer, and optionally, up to 10 weight percent of a further comonomer, said weight percent based on the total weight of the binder copolymer, and from about 3–50 weight parts of a rheology control copolymer that is a lightly cross-linked copolymer comprising from about 40–90 weight percent of an ester of an $\alpha,\beta$-ethylenically unsaturated carboxylic acid, from about 5–40 weight percent of an $\alpha,\beta$-ethylenically unsaturated carboxylic acid, from about 0.5–10 weight percent of an ethylenically unsaturated carboxamide, and optionally, up to 10 weight percent of other comonomers, said weight percents based on the total weight of the rheology control polymer.

* * * * *

UNITED STATES PATENT AND TRADEMARK OFFICE

CERTIFICATE OF CORRECTION

PATENT NO. : 4,652,471

DATED : Mar. 24, 1987

INVENTOR(S) : Bernardus J.M.S. van Rooden; Jose L.T.Martinez

It is certified that error appears in the above-identified patent and that said Letters Patent is hereby corrected as shown below:

On title page under [57] heading ABSTRACT, LINE 6, "acid, and" should read --acid, an--.

Col.1, line 27, "which can" should read --which this can--;

Col.6, line 40, "polymerization acids" should read --polymerization aids--.

Col.8, line 34, "suitable" should read --suitably--.

Signed and Sealed this

Eighth Day of March, 1988

*Attest:*

*Attesting Officer*

DONALD J. QUIGG

*Commissioner of Patents and Trademarks*